US007278451B2

(12) United States Patent
Cavallari

(10) Patent No.: US 7,278,451 B2
(45) Date of Patent: Oct. 9, 2007

(54) MACHINE FOR FILLING CONTAINERS

(75) Inventor: Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 107 days.

(21) Appl. No.: 10/523,849

(22) PCT Filed: Aug. 1, 2003

(86) PCT No.: PCT/EP03/50355

§ 371 (c)(1),
(2), (4) Date: Jul. 26, 2005

(87) PCT Pub. No.: WO2004/014779

PCT Pub. Date: Feb. 19, 2004

(65) Prior Publication Data

US 2005/0268988 A1 Dec. 8, 2005

(30) Foreign Application Priority Data

Aug. 5, 2002 (IT) ..... BO2002A0523

(51) Int. Cl.
*B65B 1/30* (2006.01)

(52) U.S. Cl. ..... 141/83; 141/152; 141/172; 141/253; 141/275

(58) Field of Classification Search ..... 141/2, 141/18, 83, 129, 144–152, 172, 253, 270, 141/275, 278; 53/53, 502, 558, 574; 177/52, 177/54

See application file for complete search history.

(56) References Cited

U.S. PATENT DOCUMENTS

| | | | | |
|---|---|---|---|---|
| 2,634,894 | A * | 4/1953 | Fischer et al. | 141/91 |
| 5,301,725 | A | 4/1994 | Meinzinger | |
| 5,689,932 | A * | 11/1997 | Peronek et al. | 53/201 |
| 5,778,633 | A | 7/1998 | Sweeny | |
| 6,073,667 | A * | 6/2000 | Graffin | 141/372 |
| 6,205,743 | B1 * | 3/2001 | Castellari | 53/53 |
| 6,399,901 | B1 * | 6/2002 | Nishino et al. | 177/52 |
| 6,619,340 | B2 * | 9/2003 | Kondo et al. | 141/152 |

FOREIGN PATENT DOCUMENTS

| | | |
|---|---|---|
| EP | 1 072 511 A | 1/2001 |
| GB | 2 264 486 A | 9/1993 |
| WO | 99 22209 | 5/1999 |

* cited by examiner

*Primary Examiner*—Timothy L. Maust
(74) *Attorney, Agent, or Firm*—Ladas and Parry LLP

(57) ABSTRACT

A machine (1) for filling containers (2) has a carousel conveyor (5) having a vertical axis (6) and in turn having a number of filling heads (7), and an equal number of seats (8), each of which houses a respective container (2), is associated with a respective filling head (7), and is connected to the carousel conveyor (5) via the interposition of a weighing device (9) supported in a fixed position by the carousel conveyor (5). Each seat (8) has a frame (10), which supports a gripper (11) for engaging a top portion (4) of a respective container (2), and a plate (12) defining a horizontal supporting surface for the bottom of the respective container (2), and an adjusting device (13) for adjusting the vertical position of the plate (12), while maintaining the gripper (11) in a given vertical position close to the respective filling head (7).

16 Claims, 3 Drawing Sheets

MACHINE FOR FILLING CONTAINERS

TECHNICAL FIELD

The present invention relates to a machine for filling containers.

The present invention may be used to particular advantage for filling bottles, to which the following description refers purely by way of example.

BACKGROUND ART

Known bottle-filling machines, such as the type described in Patent IT-1136276, comprise a vertical-axis carousel conveyor having a number of seats, which are arranged symmetrically about the vertical axis of the conveyor, house respective bottles by means of a horizontal supporting surface, and are connected to the conveyor in fixed positions. Each seat is associated with a filling head, which is fitted to a supporting disk connected to the conveyor so as to slide with respect to and along the vertical axis of the conveyor, and fills a bottle housed in the respective seat as the conveyor rotates. A load cell is interposed between each seat and the conveyor to real-time weigh the bottle as it is being filled. The real-time bottle weight measurement is used to feedback control the respective filling head and so ensure the bottle is filled with exactly the required amount of product. In actual use, an empty bottle is fed into a respective seat on the conveyor at an input station along the periphery of the conveyor, is subsequently filled by the filling head associated with the seat as the conveyor rotates, and is removed from the seat at an output station located along the periphery of the conveyor and downstream from the input station in the rotation direction of the conveyor.

In a known filling machine of the above type, to make a size change, i.e. to adapt the machine to operate with bottles of a different height, the vertical position of the filling heads must be adjusted by moving the supporting disk vertically along the conveyor so that each filling head is positioned, in use, close to the neck of the relative bottle. Sliding the supporting disk vertically with respect to the conveyor, however, is a slow, complicated job, in that the supporting disk is relatively heavy, and therefore cannot be moved manually by an operator, and, what is more, is connected to the tank and all the conduits supplying the product with which the bottles are filled.

To eliminate the above drawback, Patent Application WO9922209 proposes a filling machine, in which, as opposed to a bottom supporting surface for the relative bottle, each seat simply comprises a gripper for engaging and supporting the bottle by the neck. The bottle thus hangs from the gripper, so that each seat can house bottles of different heights with no alteration required, in that the position of the neck of the bottle is constant. In actual use, however, the centrifugal force generated by rotation of the conveyor on the bottle hanging by its neck tends to tilt and oscillate the hanging bottle with respect to the vertical, thus resulting in a random error in the bottle weight measured by a load cell interposed between the gripper and conveyor.

DISCLOSURE OF INVENTION

It is an object of the present invention to provide a machine for filling containers, designed to eliminate the aforementioned drawbacks, and which, in particular, is cheap and easy to produce.

According to the present invention, there is provided a machine for filling containers; the machine comprising a carousel conveyor having a vertical axis, and in turn comprising a number of filling heads, and an equal number of seats, each of which houses a respective container, is associated with a respective filling head, and is connected to the carousel conveyor via the interposition of a weighing device supported in a fixed position by the carousel conveyor; each seat comprising a frame, a gripper fitted to the frame and for engaging a top portion of a respective container, and a plate fitted to the frame and defining a horizontal supporting surface for the bottom of the respective container; the machine being characterized in that each seat comprises an adjusting device associated with the respective frame and for adjusting the vertical position of the plate, while maintaining the gripper in a given vertical position close to the corresponding filling head.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
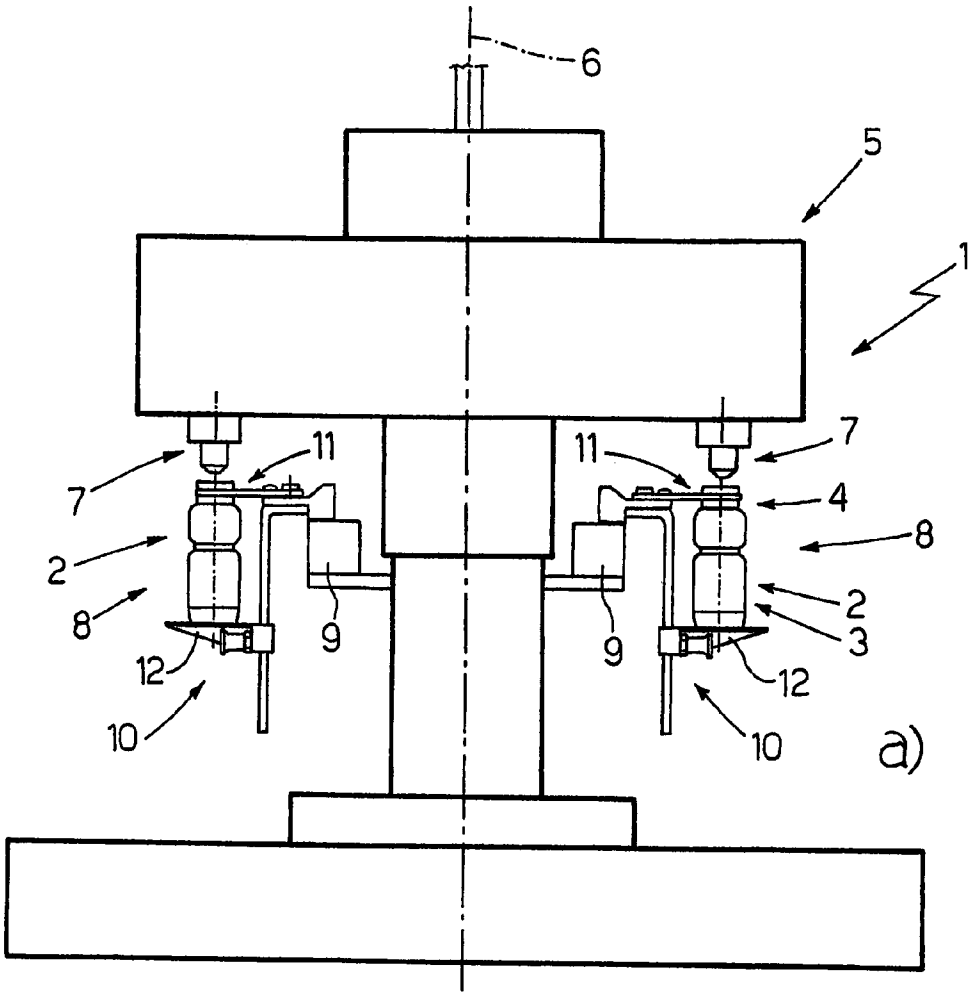
FIG. 1 shows a schematic side view, with parts removed for clarity, of a preferred embodiment of the filling machine according to the present invention.
Figure 1:
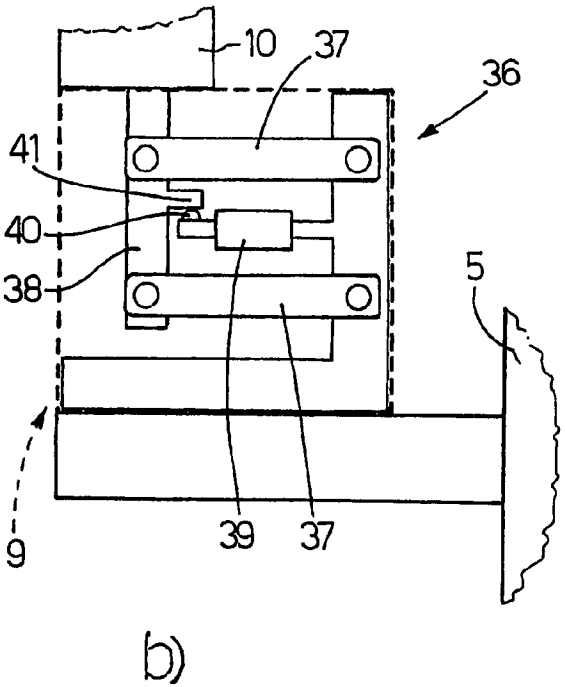

Number 1 in FIG. 1 indicates as a whole a filling machine for filling bottles 2, each of which comprises a substantially cylindrical body 3, which tapers at the top to form a neck 4 having a threaded end portion for closure by a threaded cap (not shown). Filling machine 1 comprises a carousel conveyor 5 having a vertical axis 6, and in turn comprising a number of filling heads 7, and an equal number of seats 8, each of which houses a respective bottle 2, is associated with a respective filling head 7, and is connected to conveyor 5 via the interposition of a weighing device 9 fitted to conveyor 5 in a fixed position. Weighing device 9 provides for real-time weighing bottle 2 as it is being filled; and the real-time weight measurement of bottle 2 is used to feedback control relative filling head 7 and to ensure bottle 2 is filled with exactly the desired amount of product.

In actual use, an empty bottle 2 is fed into a respective seat 8 at a known input station (not shown) along the periphery of conveyor 5, is subsequently filled by the filling head 7 associated with seat 8 as conveyor 5 rotates, and is removed from seat 8 at a known output station (not shown) located along the periphery of conveyor 5 and downstream from the input station in the rotation direction of conveyor 5.

Figure 2:
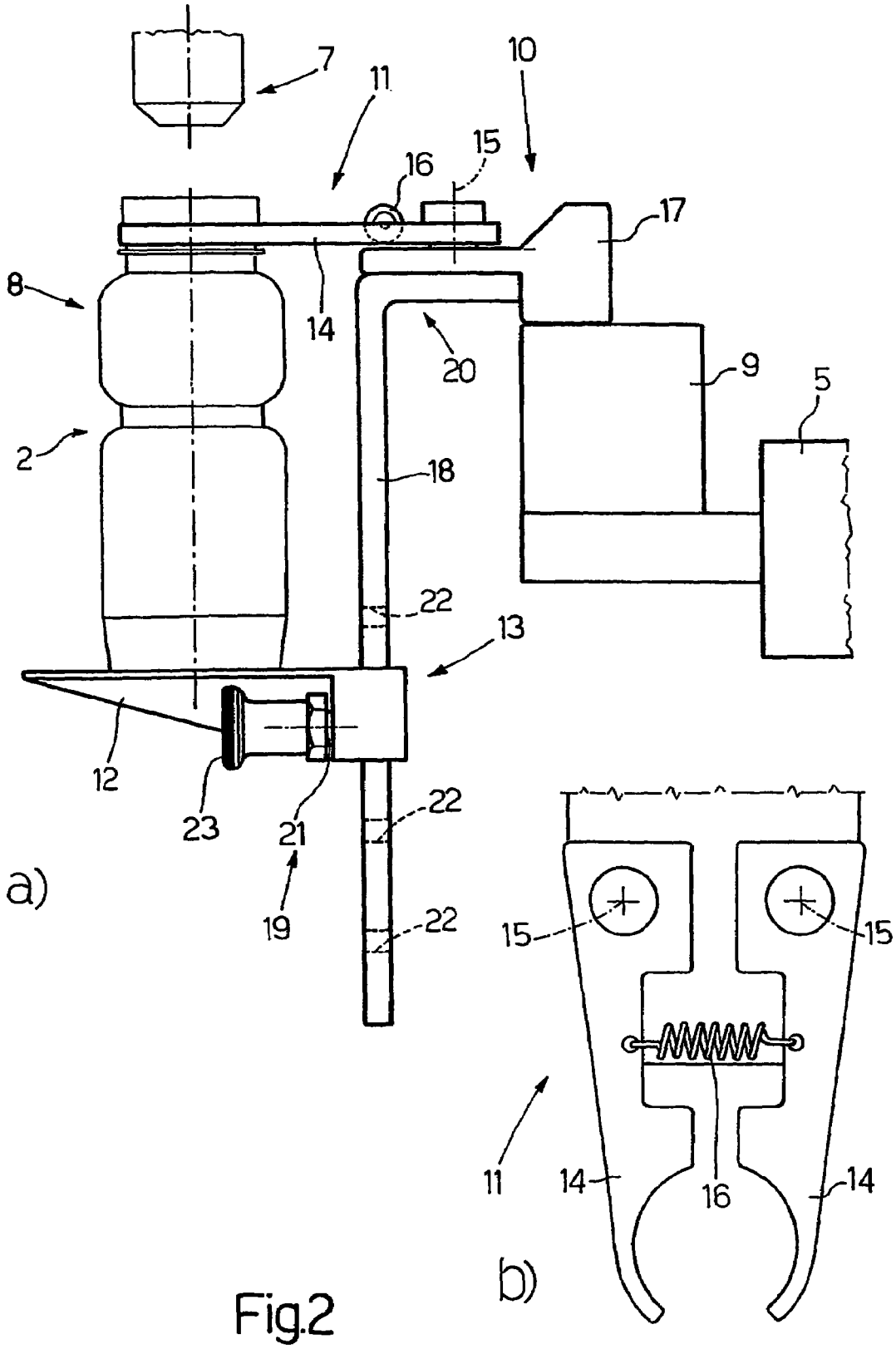
FIG. 2 shows a larger-scale side view of a detail of the FIG. 1 filling machine.
Figure 3:
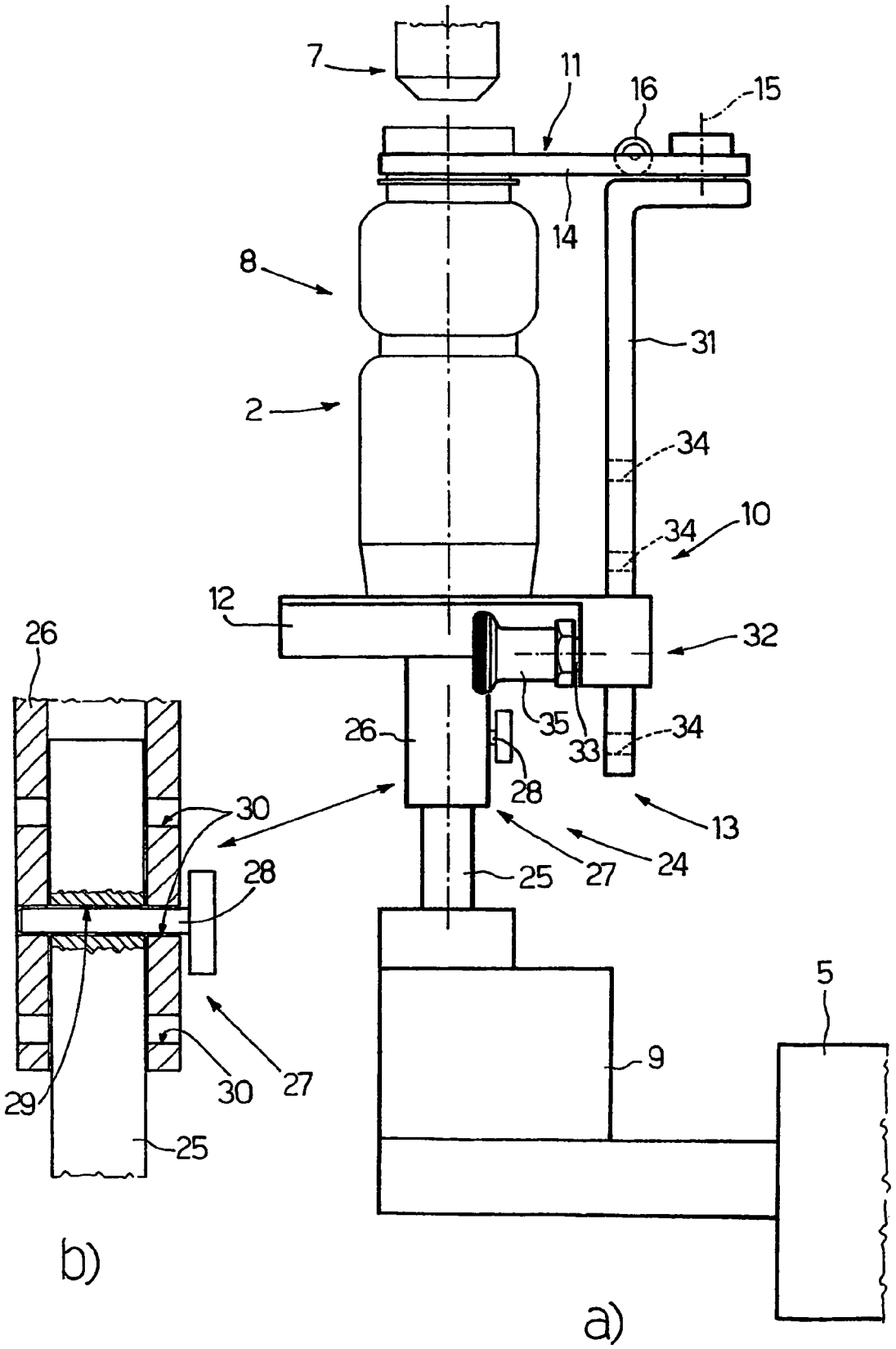
FIG. 3 shows a larger-scale side view of an alternative embodiment of the FIG. 2 detail.

As shown in FIGS. 2 and 3, each seat 8 comprises a frame 10, which supports a gripper 11 for engaging neck 4 of a respective bottle 2, and a plate 12 defining a horizontal supporting surface for the bottom of respective bottle 2. Each seat 8 also comprises an adjusting device 13 associated with relative frame 10 and for adjusting the vertical position of plate 12, while maintaining gripper 11 in a given vertical position close to the corresponding filling head 7. More specifically, when housed inside a respective seat 8, bottle 2 rests on plate 12, which supports the whole weight of bottle 2, and gripper 11 simply serves to hold neck 4 of bottle 2 in a given position of alignment with corresponding filling head 7, and so prevent any accidental horizontal movements (normally caused by stress induced by rotation of conveyor 5). Inside respective seat 8, each bottle 2 rests on plate 12, which supports the whole weight of bottle 2, and is also retained by gripper 11, so that the centrifugal force generated on bottle 2 by rotation of conveyor 5 produces no tilting or oscillation of bottle 2 with respect to the vertical, and the weight of bottle 2 measured by weighing device 9 is therefore more accurate.

Each gripper 11 comprises two jaws 14 hinged to respective frame 10 to oscillate about respective vertical axes 15; and an elastic member, e.g. a spring 16, which tends to keep jaws 14 in an engaged position engaging neck 4 of a respective bottle with a given force.

As shown in FIG. 2, each frame 10 comprises a fixed supporting member 17 connected rigidly to the corresponding weighing device 9, and supporting relative gripper 11 in a fixed position, and relative plate 12 in an adjustable position. Supporting member 17 comprises a vertical rod 18, along which plate 12 slides, and a releasable connecting member 19 for connecting plate 12 to rod 18; and vertical rod 18 comprises an L-shaped top end 20 connected by screws (not shown) to the rest of supporting member 17.

Releasable connecting member 19 comprises a horizontally movable key 21 fitted to plate 12; and a number of holes 22, each formed along rod 18 and engageable by key 21. Key 21 preferably comprises a known spring (not shown) for keeping key 21 in an engaged position inside a respective hole 22; and an operator grip 23 on one end of key 21.

To make a size change, the operator simply adjusts the position of plates 12 along respective rods 18, which can be done quickly and easily by one operator simply moving each plate 12 (which is extremely light) along respective rod 18 using respective key 21.

As shown in FIG. 3, each frame 10 comprises a vertical telescopic connecting member 24, which has a fixed portion 25 connected rigidly to the corresponding weighing device 9, and a vertically movable portion 26 supporting relative plate 12 in a fixed position, and relative gripper 11 in an adjustable position. Fixed portion 25 of telescopic connecting member 24 is connected to movable portion 26 by a releasable connecting member 27, which comprises a key 28 for simultaneously engaging a hole 29 in fixed portion 25, and a hole 30 in movable portion 26, which has a number of holes 30 by which to set movable portion 26 to a number of alternative positions.

Plate 12 supports in sliding manner a vertical rod 31 supporting gripper 11 in a fixed position. Rod 31 is connected to plate 12 by a releasable connecting member 32, which comprises a horizontally movable key 33 fitted to plate 12, and a number of holes 34, each formed along rod 31 and engageable by key 33. Key 33 preferably comprises a known spring (not shown) for keeping key 33 in an engaged position inside a respective hole 34; and an operator grip 35 on one end of key 33.

To make a size change, the operator simply adjusts the position of plates 12 by means of respective telescopic connecting members 24, and simultaneously adjusts the vertical distance between each plate 12 and respective gripper 11 using corresponding connecting member 32 to fix gripper 11 in a given vertical position close to the corresponding filling head 7, which operation can obviously be done quickly and easily by one operator.

Each weighing device 9 preferably comprises an articulated parallelogram 36 defined by two rocker arms 37 hinged at one end to conveyor 5 and at the other end to a connecting rod 38 supporting relative frame 10. A load cell 39 is connected on one side to conveyor 5, and is connected on the other side to connecting rod 38 by a spherical bowl-shaped projection 40 defining a substantially point contact between load cell 39 and a projection 41 of connecting rod 38. Load cell 39 is therefore subjected to substantially only vertical forces, which are the only ones permitted by the point contact between spherical bowl-shaped projection 40 and connecting rod 38, so that any residual non-vertical forces transmitted by frame 10 to weighing device 9 as a result of conveyor 5 rotating about axis 6 have no effect on the reading of weighing device 9.

The invention claimed is:

1. A machine for filling containers (2);

the machine comprising a carousel conveyor (5) having a vertical axis (6), and in turn comprising a number of filling heads (7), and an equal number of seats (8), each of which houses a respective container (2), is associated with a respective filling head (7), and is connected to the carousel conveyor (5) via the interposition of a weighing device (9) supported in a fixed position by the carousel conveyor (5);

each seat (8) comprising a frame (10), a gripper (11) fitted to the frame (10) and for engaging a top portion (4) of a respective container (2), a plate (12) fitted to the frame (10) and defining a horizontal supporting surface for the bottom of the respective container (2) and an adjusting device (13) associated with the respective frame (10) and for adjusting the vertical position of the plate (12), while maintaining the gripper (11) in a given vertical position close to the corresponding filling head (7), wherein each weighing device (9) comprises an articulated parallelogram (36) defined by two rocker arms (37) hinged at one end to the carousel conveyor (5). and at the other end to a connecting rod (38) supporting the relative frame (10); a load cell (39) being connected on one side to the carousel conveyor (5), and on the other side to the connecting rod (38).

2. A machine as claimed in claim 1, wherein each frame (10) comprises a fixed supporting member (17) connected rigidly to the corresponding weighing device (9), and supporting the relative gripper (11) in a fixed position, and the relative plate (12) in an adjustable position.

3. A machine as claimed in claim 2, wherein the supporting member (17) comprises a vertical rod (18), along which the plate (12) slides; releasable connecting means (19) being provided to connect the plate (12) to the vertical rod (18).

4. A machine as claimed in claim 3, wherein the vertical rod (18) comprises an L-shaped top end (20) connected by screws to the rest of supporting member (17).

5. A machine as claimed in claim 3, wherein the releasable connecting means (19) comprise a horizontally movable key (21) fitted to the plate (12), and a number of holes (22), each formed along the vertical rod (18) and engageable by the key (21).

6. A machine as claimed in claim 5, wherein the key (21) comprises a spring for keeping the key (21) in an engaged position inside a respective hole (22), and an operator grip (23) on one end of the key (21).

7. A machine as claimed in claim 2, wherein each frame (10) comprises a vertical telescopic supporting member (24), which has a fixed portion (25) connected rigidly to the corresponding weighing device (9), and a vertically movable portion (26) supporting the relative plate (12) in a fixed position, and the relative gripper (11) in an adjustable position; first releasable connecting means (27) being provided to connect the fixed portion (25) of the telescopic supporting member (24) to the movable portion (26).

8. A machine as claimed in claim 7, wherein the plate (12) supports in sliding manner a vertical rod (31) supporting the gripper (11) in a fixed position; second releasable connecting means (32) being provided to connect the vertical rod (31) to the plate (12).

9. A machine as claimed in claim 8, wherein the second releasable connecting means (32) comprise a horizontally movable key (33) fitted to the plate (12), and a number of holes (34), each formed along the vertical rod (31) and engageable by the key (33).

10. A machine as claimed in claim 9, wherein the key (33) comprises a spring for keeping the key (33) in an engaged position inside a respective hole (34), and an operator grip (35) on one end of the key (33).

11. A machine as claimed in claim 1, wherein each gripper (11) comprises two jaws (14) hinged to the respective frame (10) to oscillate about respective vertical axes (15); and an elastic member (16), which tends to keep the jaws (14) in an engaged position engaging the top portion (4) of a respective container (2).

12. A machine as claimed in claim 1, wherein the load cell (39) is connected to the connecting rod (38) by a spherical bowl-shaped projection (40), which engages a horizontal projection (41) on the connecting rod (38) and forms a substantially point contact between the load cell (39) and the connecting rod (38).

13. In a machine for filling containers (2), the machine comprising a carousel conveyor (5) having a vertical axis (6) and seats (8) respectively for the containers (2), respectively associated with filling heads (7), and respectively connected to the carousel conveyor (5) by weighing devices (9), the improvements wherein:

each seat (8) comprises a frame (10), a gripper (11) fitted to the frame (10) and for engaging a top portion (4) of a respective container (2), a plate (12) fitted to the frame (10) and defining a horizontal supporting surface for the bottom of the respective container (2) and an adjusting device (13) associated with the respective frame (10) and for adjusting the vertical position of the plate (12), while maintaining the gripper (11) in a given vertical position close to the corresponding filling head (7), wherein each frame (10) comprises a fixed supporting member (17) connected rigidly to the corresponding weighing device (9), and supporting the relative gripper (11) in a fixed position, and the relative plate (12) in an adjustable position, and each frame (10) comprises a vertical telescopic supporting member (24), which has a fixed portion (25) connected rigidly to the corresponding weighing device (9), and a vertically movable portion (26) supporting the relative plate (12) in a fixed position, and the relative gripper (11) in an adjustable position; first releasable connecting means (27) being provided to connect the fixed portion (25) of the telescopic supporting member (24) to the movable portion (26).

14. The machine as claimed in claim 13, wherein the plate (12) supports in sliding manner a vertical rod (31) supporting the gripper (11) in a fixed position; second releasable connecting means (32) being provided to connect the vertical rod (31) to the plate (12).

15. The machine as claimed in claim 13, wherein the second releasable connecting means (32) comprise a horizontally movable key (33) fitted to the plate (12), and a number of holes (34), each formed along the vertical rod (31) and engageable by the key (33).

16. The machine as claimed in claim 13, wherein the key (33) comprises a spring for keeping the key (33) in an engaged position inside a respective hole (34), and an operator grip (35) on one end of the key (33).

* * * * *